US009114326B2

(12) United States Patent
Johnson et al.

(10) Patent No.: US 9,114,326 B2
(45) Date of Patent: Aug. 25, 2015

(54) TWILIGHT DEVICE

(75) Inventors: Jeff Johnson, Lawndale, CA (US); Nader Hamda, Torrance, CA (US); Linda Suh, Torrance, CA (US)

(73) Assignee: Cloud B, Inc., Gardena, CA (US)

( * ) Notice: Subject to any disclaimer, the term of this patent is extended or adjusted under 35 U.S.C. 154(b) by 275 days.

(21) Appl. No.: 11/132,035

(22) Filed: May 19, 2005

(65) Prior Publication Data

US 2006/0194508 A1 Aug. 31, 2006

Related U.S. Application Data

(60) Provisional application No. 60/656,618, filed on Feb. 25, 2005.

(51) Int. Cl.
*A63H 3/00* (2006.01)
*A63H 33/26* (2006.01)

(52) U.S. Cl.
CPC ..... *A63H 33/26* (2013.01); *A63H 3/003* (2013.01); *A63H 3/006* (2013.01)

(58) Field of Classification Search
CPC ..... A63H 3/003; A63H 3/006; A63H 33/26
USPC ..... 446/72, 175, 485
See application file for complete search history.

(56) References Cited

U.S. PATENT DOCUMENTS

| | | | | | |
|---|---|---|---|---|---|
| 2,421,958 | A * | 6/1947 | Moretti | 362/124 |
| 2,632,359 | A * | 3/1953 | Spitz | 434/286 |
| 2,861,173 | A * | 11/1958 | Nordquist | 362/150 |
| 4,173,038 | A * | 10/1979 | Kiefer | 362/35 |
| 4,497,582 | A * | 2/1985 | Lipman et al. | 368/15 |
| 4,579,534 | A * | 4/1986 | Lipman et al. | 434/286 |
| 4,858,079 | A * | 8/1989 | Ohashi | 362/35 |
| 4,942,502 | A * | 7/1990 | Ohashi | 362/35 |
| 4,955,714 | A * | 9/1990 | Stotler et al. | 353/62 |
| 5,082,447 | A * | 1/1992 | Hinkle | 434/286 |
| 5,114,376 | A * | 5/1992 | Copley et al. | 446/369 |
| 5,324,224 | A * | 6/1994 | Anderson et al. | 446/91 |
| 6,113,455 | A * | 9/2000 | Whelan et al. | 446/227 |
| 6,142,846 | A * | 11/2000 | Ojakaar | 446/72 |
| 6,165,037 | A * | 12/2000 | Van Zant | 446/219 |
| 6,894,434 | B1 * | 5/2005 | Kosoff | 315/134 |
| 2004/0007710 | A1 * | 1/2004 | Roy et al. | 257/88 |
| 2006/0007676 | A1 * | 1/2006 | Song | 362/195 |

* cited by examiner

*Primary Examiner* — Gene Kim
*Assistant Examiner* — Alyssa Hylinski

(57) ABSTRACT

A device being in the form of a predetermined animal having a light emitting feature. The animal has at least a head and body. A plurality of light emitting members of varying colors being placed within the body, and a plurality of apertures being formed through the top surface of the body. Each aperture being in the shape of a star, and the placement of the apertures forming the pattern of a predetermined constellation. The light emitting members and apertures being formed in a manner such that light shines through the apertures and projects outwardly when the light emitting members are turned on.

1 Claim, 3 Drawing Sheets

TWILIGHT DEVICE

RELATED APPLICATIONS

This application claims the benefit of Provisional Patent Application No. 60/656,618, filed Feb. 25, 2005. The entire contents of this provisional patent application are incorporated by reference herein.

BACKGROUND OF THE INVENTION

1. Field of the Invention

This invention relates to toy devices, and more particularly, this invention relates to a toy having a light emitting feature.

2. Description of the Prior Art

There are toys shaped in the form of miscellaneous animals. Some of these toys are simply stuffed with materials while others are simply hollow. There are some which have glow in the dark features. Others have light built therein on predetermined parts thereof which light up with the application of pressure on a predetermined portion thereof. However, there is no known device in the prior art as the twilight device taught in the present invention.

It is a primary objective of the present invention to provide a toy device shaped in the form of an animal which has a light emitting feature. It is another objective of the present invention to provide a toy device which can function as a night light.

SUMMARY OF THE INVENTION

The present invention is a toy device having a light emitting feature. The device is a toy being shaped in the form of a predetermined animal. The animal has at least a head and body. Within the body is housed a plurality of light emitting members of varying colors. The body has a plurality of apertures formed therethrough. The apertures can be in the shape of stars. The light emitting members and apertures are formed in a manner such that light shines through the apertures and projects outwardly when the light emitting members are turned on.

BRIEF DESCRIPTION OF THE DRAWINGS

With the above and additional objects and advantages in view, as will hereinafter appear, this invention comprises the devices, combinations and arrangements of parts hereinafter described, by way of example, and illustrated in the accompanying drawings of a an embodiment in which.

DETAILED DESCRIPTION AN EMBODIMENT

Figure 1:
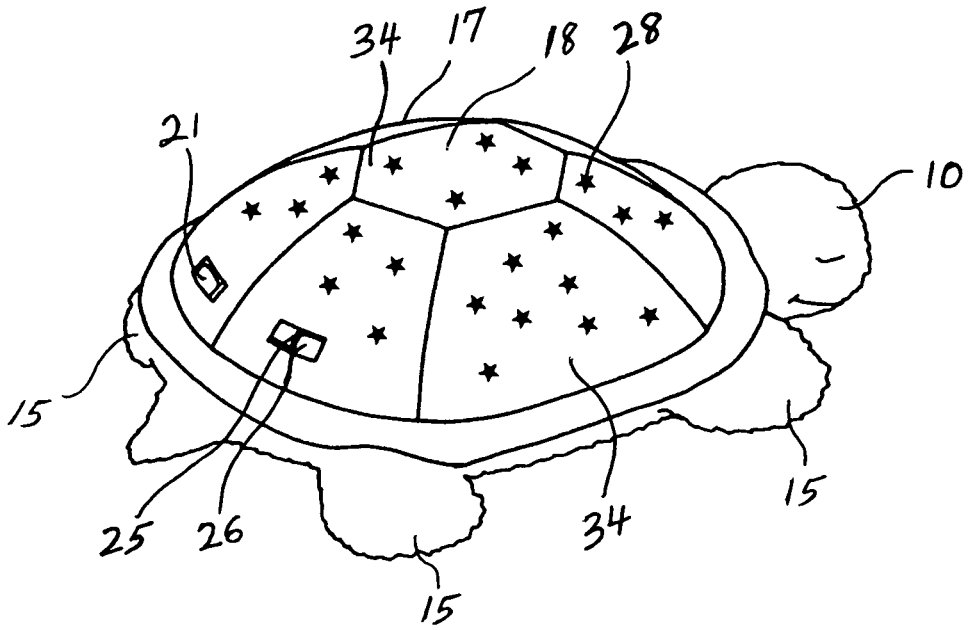
FIG. 1 is a top perspective view of the present invention.

The present invention as shown in FIG. 1 is a toy device having a light emitting feature. The device is a toy being shaped in the form of a predetermined animal. For purposes of illustration, the toy in FIG. 1 is shaped in the form of a turtle. The animal has at least a head, body, and top surface of the body. The turtle in FIG. 1 has a head 10, four arms 15, body 17, top surface of the body 18, and tail 19. For the turtle in FIG. 1, the top surface of the body 18 is a shell. Housed within the body 17 are a plurality of light emitting members 20 of varying colors. The light emitting members 20 can be those known in the art including light bulbs and LED. A timer unit is operatively connected to the light emitting members. A start key 21 is placed on the toy device for controlling the timer unit. The timer unit functions to activate the light emitting members 20 to be turned on for a predetermined period of time. The toy device further includes a color select switch 25 having two or more slots 26 placed thereon for controlling which of the plurality of light emitting members 20 will be turned on at a given time. Each slot 26 on the color select switch 25 corresponds to a different predetermined selection of the plurality of light emitting members 20 which will be turned on together. The selection of lights can be random or based on those light emitting members 20 having the same colors.

Also, within the body is a placed a reflector base 23 surrounding the light emitting members 20. The reflector base 23 has a reflective top surface 24.

The body 17 has a plurality of apertures 28 formed through the top surface 18 thereof. In the illustration shown of the turtle, the top surface of the body 17 is the shell 18. FIG. 1 shows the apertures 28 extending through the shell 18 and into the body 17. The shell 18 can be an opaque shell made of a plastic material. In the embodiment shown, a battery box 31 for containing one or more batteries is provided in the toy device for supplying power to the operation of the light emitting members 20. The apertures 28 can be shaped into predetermined forms, and also can be arranged in desired patterns. Each aperture shown in FIG. 1 is in the shape of a star, and the apertures are arranged in the form of a constellation. The light emitting members 20 and apertures 28 are formed in a manner such that light shines through the apertures 28 and projects outwardly when the light emitting members 20 are turned on. In use, the effect of the light emitting through the apertures 28 is the creation of a star filled night sky on the ceiling and/or walls of a room.

Figure 2:
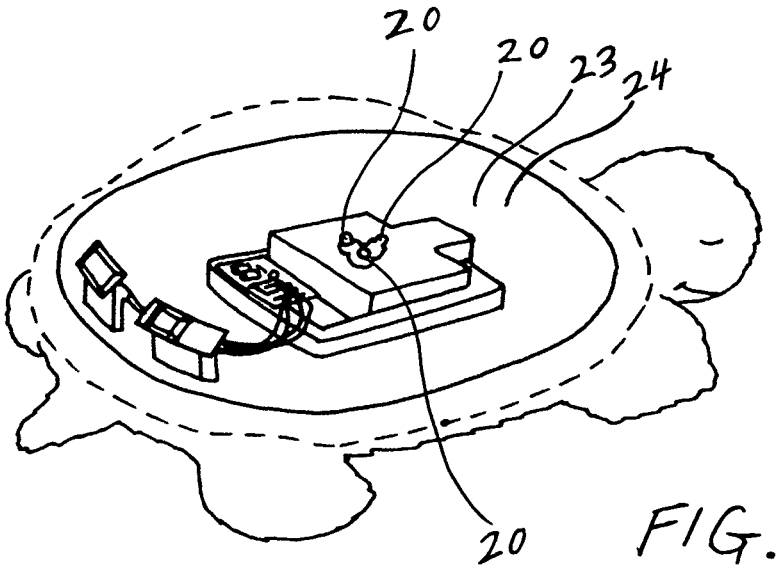
FIG. 2 is a top perspective view of the present invention showing the inner components of the body of the device; and, FIG. 3 is a bottom perspective view of the present invention.
Figure 3:
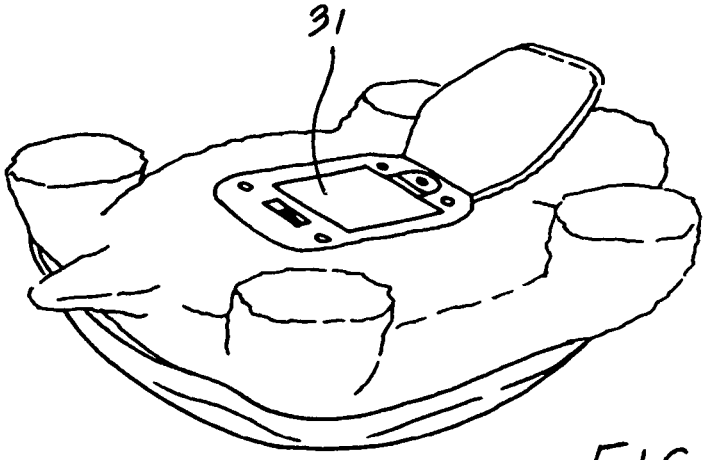

In addition, in the embodiment illustrated in FIGS. 1-3, the turtle has a shell 18 divided into multiple sections 34. All sections 34 can have apertures 28 formed therethrough to form the identical constellation pattern on each section 34. In the alternative, all sections 34 can have apertures 28 formed therethrough to form a different constellation pattern on each section 34.

While embodiments of the invention has been described and illustrated for purposes of clarity and example, it should be understood that many changes, substitutions and modifications to the described embodiments will be apparent to those having skill in the art in light of the foregoing disclosure without departing from the scope and spirit of the present invention which is defined by the claims which will follow.

What is claimed is:

1. A nightlight consisting of:

a turtle shaped housing including a body having a turtle shell-shaped top, a head and a tail;

at least three light emitting members comprising a first light emitting member contained inside of the housing, a second light emitting member contained inside of the housing and a third light emitting member contained inside of the housing, each of the first light emitting member, the second light emitting member and third light emitting member of a different color;

a color selector switch positioned on the turtle shell-shaped top, in electrical communication with each of said light emitting member and adapted to turn on any one of said three light emitting members without turning on either remaining two of the three light emitting members;

the turtle shell-shaped top formed of an opaque material and having a plurality of star-shaped apertures formed through said top; and, the plurality of apertures arranged in a predetermined form of a constellation of stars.

* * * * *